US006170879B1

(12) United States Patent
Rawlings

(10) Patent No.: US 6,170,879 B1
(45) Date of Patent: Jan. 9, 2001

(54) RETURNABLE SHIPPING LABEL

(75) Inventor: Timothy W. Rawlings, Waynesville, OH (US)

(73) Assignee: NCR Corporation, Dayton, OH (US)

( * ) Notice: Under 35 U.S.C. 154(b), the term of this patent shall be extended for 0 days.

(21) Appl. No.: 09/261,780

(22) Filed: Mar. 3, 1999

(51) Int. Cl.[7] ..... B42D 15/00
(52) U.S. Cl. ..... 283/81; 283/80; 283/101
(58) Field of Search ..... 283/79, 80, 81, 283/67, 70, 101, 105, 56; 40/299, 310, 312, 630, 638; 428/41.8, 42.2, 42.3

(56) References Cited

U.S. PATENT DOCUMENTS

| | | | |
|---|---|---|---|
| 107,166 | 9/1870 | Davis . | |
| 709,805 | 9/1902 | Sterns et al. . | |
| 1,245,447 | 11/1917 | Felenchak . | |
| 1,303,063 | 5/1919 | Hoock . | |
| 2,563,340 | 8/1951 | Kelly . | |
| 3,380,648 | 4/1968 | De Lyra . | |
| 3,545,669 | 12/1970 | Kinkade et al. . | |
| 3,822,492 | 7/1974 | Crawley . | |
| 4,159,129 | 6/1979 | Lockhart . | |
| 4,479,838 * | 10/1984 | Dunsirn et al. | 283/79 X |
| 4,637,635 | 1/1987 | Levine . | |
| 5,248,082 | 9/1993 | Elmlinger . | |
| 5,289,972 | 3/1994 | Sauerwine et al. . | |
| 5,360,160 | 11/1994 | Sauerwine et al. . | |
| 5,370,302 | 12/1994 | Dyer . | |
| 5,383,686 * | 1/1995 | Laurash | 283/79 X |
| 5,413,383 | 5/1995 | Laurash et al. . | |
| 5,476,698 | 12/1995 | Denny | 428/40 |
| 5,520,990 | 5/1996 | Rotermund . | |
| 5,547,227 * | 8/1996 | Laurash et al. | 283/79 X |

FOREIGN PATENT DOCUMENTS

| | | |
|---|---|---|
| 0329370 | 8/1989 | (EP) . |
| 2177373 | 1/1987 | (GB) . |

OTHER PUBLICATIONS

Co–pending Application Serial No. 09/261,779, filed Mar. 3, 1999, by inventor Timothy W. Rawlings., entitled "Returnable Mailer", assigned to NCR Corporation.

* cited by examiner

*Primary Examiner*—Willmon Fridie, Jr.
(74) *Attorney, Agent, or Firm*—Francis L. Conte

(57) ABSTRACT

A shipping laminate includes a label for printing a recipient first address, with a release liner disposed thereunder. The label is releasably bonded to the liner and is removable therefrom. The liner contains a recipient second address hidden behind the label, and is viewable upon removal thereof.

13 Claims, 4 Drawing Sheets

RETURNABLE SHIPPING LABEL

CROSS-REFERENCE TO RELATED APPLICATION

The present invention is related to U.S. patent application Ser. No. 09/261,779 filed concurrently herewith, and entitled "Returnable Mailer."

BACKGROUND OF THE INVENTION

The present invention relates generally to labels, and, more specifically, to address labels.

Mailers are available in various configurations and sizes for sending various items from a sender at one address to recipient at another address. A typical mailer is in the form of a container such as a flat envelope, rectangular box, or a cylindrical tube, for example, in which paper correspondence or three dimensional articles may be packaged for delivery.

Recipient and return addresses may be printed directly on the mailers, or may be applied thereto in the form of pressure sensitive labels. Such labels are commonly found in a string or sheet of multiple labels permitting batch addressing to various recipients, commonly from a single sender.

A typical label sheet is a laminate containing several labels adhesively bonded to a common underlying release liner, typically referred to as pressure sensitive labels. Correspondence addresses may be printed on the individual labels in a suitable printer, with the labels then being individually peeled from the liner and affixed to corresponding mailers using the same adhesive found on the back side of the labels. The mailer may then be suitably shipped through the U.S. Postal Service, or private carrier, or local courier to the intended recipient.

When containers are used to ship merchandise to a customer, it is common for the customer to use the same container to return to the sender the merchandise when it fails to meet requirements. The original recipient address must then be obliterated by being either removed or marked over, or a new label may be affixed over the original recipient address. Should the container have a separate return address thereon from the original sender, that return address must also be removed or supplanted.

The quality and security of the replacement addresses on the same container may vary significantly depending on the care and method used for readdressing. In the worst case, a reapplied label may fall off during the return trip of the container, and interrupt the delivery.

Accordingly, it is desired to provide an improved shipping label for both sending a container to a recipient, and returning the same container to a second recipient, such as the original sender.

BRIEF SUMMARY OF THE INVENTION

A shipping laminate includes a label for printing a recipient first address, with a release liner disposed thereunder. The label is releasably bonded to the liner and is removable therefrom. The liner contains a recipient second address hidden behind the label, and is viewable upon removal thereof.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
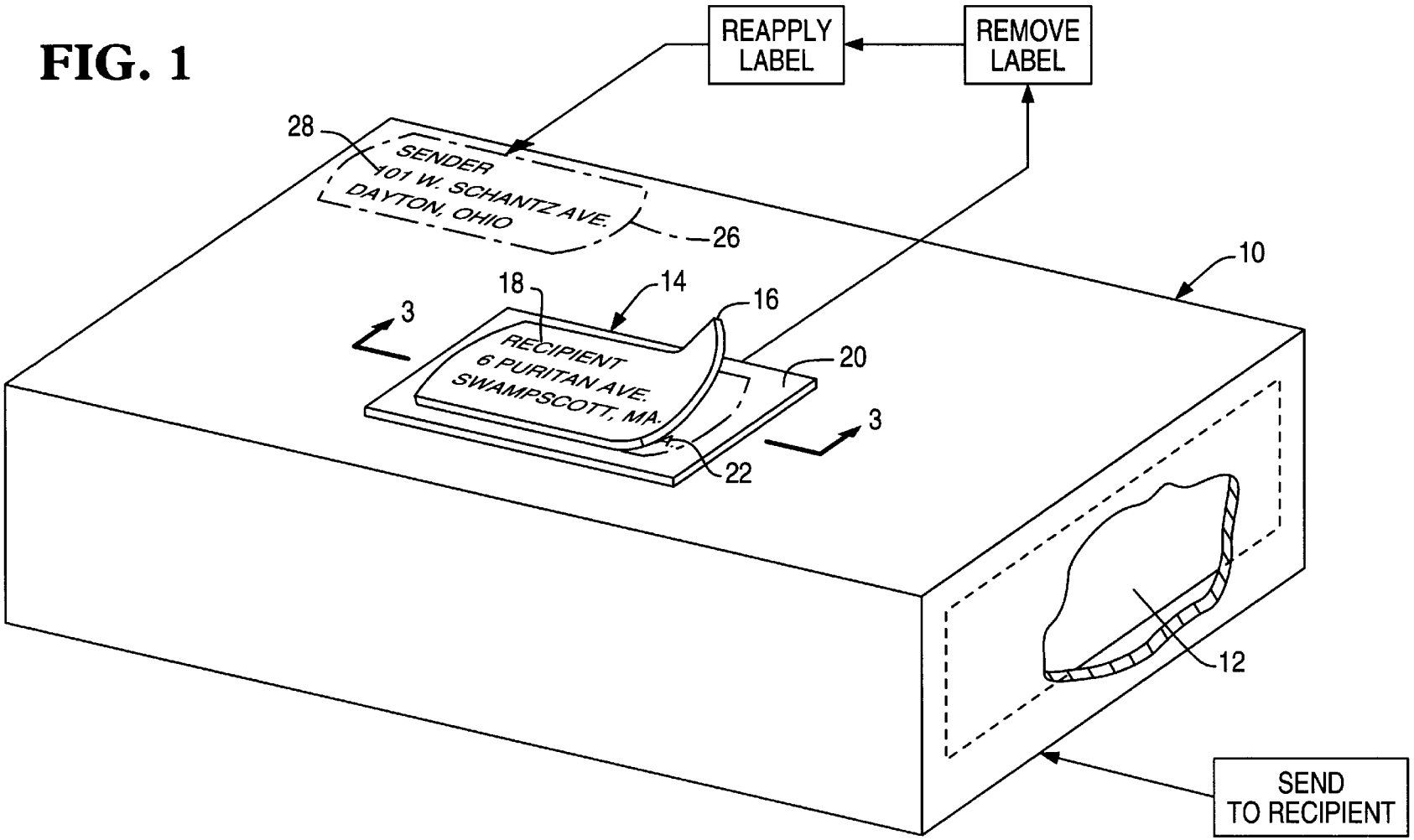
FIG. 1 is an isometric view of an exemplary shipping container having a returnable shipping label in accordance with an exemplary embodiment of the present invention.

Illustrated in FIG. 1 is a shipping container 10 configured for shipping an item or article 12 to a recipient. The container may take any conventional form such as the rectangular box illustrated, or a cylindrical shipping tube, or flat envelopes, for example. The article 12 may have any conventional form such as merchandise, or written correspondence of one or more sheets, for example. And, the container may be mailed or shipped using any suitable means such as U.S. Postal Service, or private carrier, or local courier, for example.

A shipping label or laminate 14 is provided in accordance with the present invention for attachment to the container for identifying the recipient, as well as permitting re-shipment of the same container to a second recipient, which may be the original sender. The laminate 14 includes a pressure sensitive address label 16 having a front face or surface upon which may be printed a recipient first address 18.

A release liner 20 is initially disposed under the label 16, with the label being releasably bonded thereto by a suitable adhesive covering the back side or surface of the label. The liner may have any conventional configuration, such as paper, having a release agent, such as silicone, coated thereon for permitting removal of the label by being peeled away therefrom. The adhesive typically used for pressure sensitive labels is permanently bonded to the label back and is releasable from the liner so that the label may be reapplied to other surfaces as desired.

Figure 2:
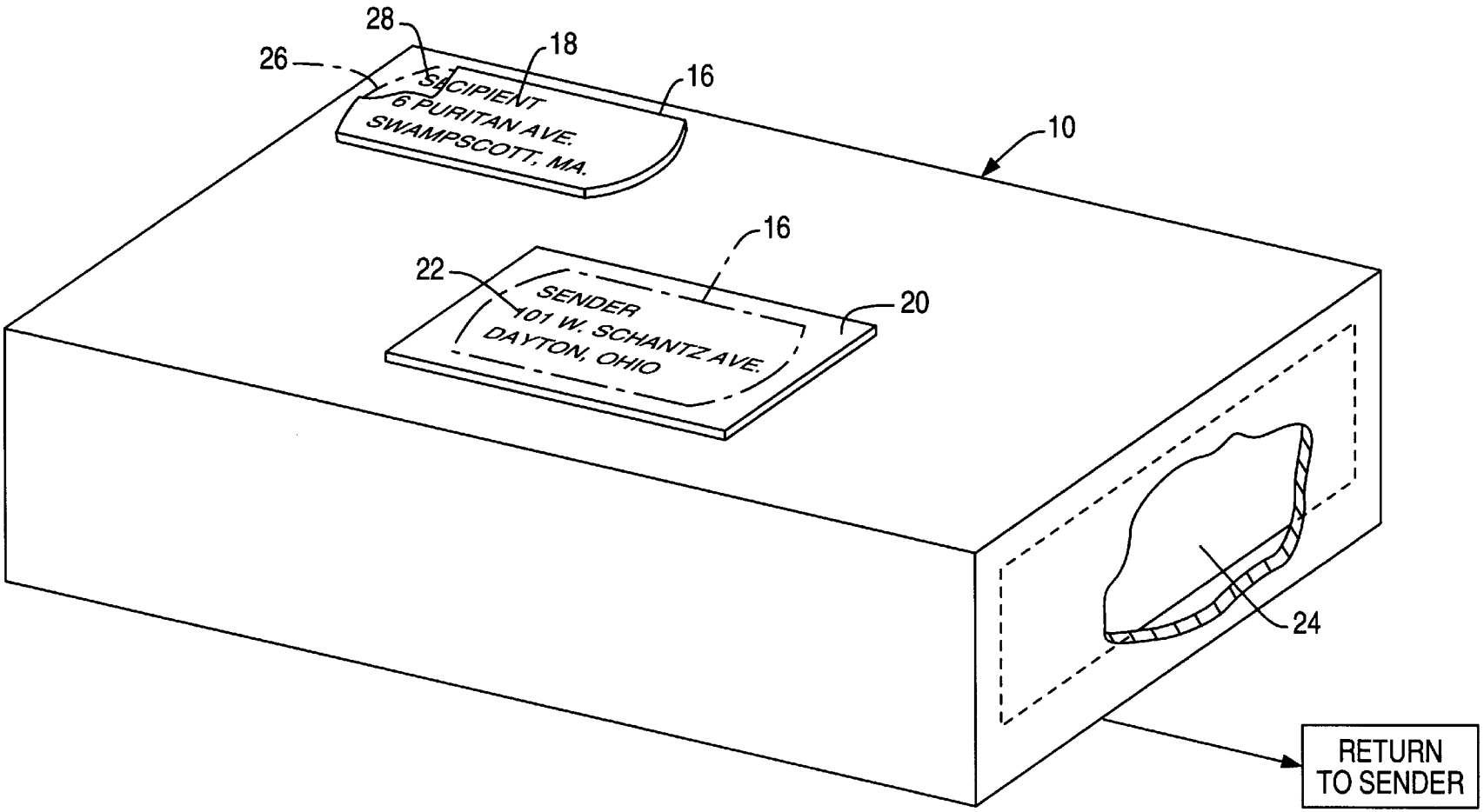
FIG. 2 is an isometric view of the container illustrated in FIG. 2 with the shipping label removed from an underlying liner and reaffixed atop the return address for returning the container to the sender.

FIG. 1 illustrates a label 16 being removed from the liner 20 for exposing therebelow a recipient second address 22, more clearly shown in FIG. 2 after removal of the label. In accordance with the present invention, the liner 20 contains the second address 22 printed thereatop and initially hidden behind the label 16 laminated thereto, with the second address being viewable upon removal of the label.

In a typical method of use, the second address 22 is preprinted atop the liner during the manufacturing process of the laminate 14. The first address 18 may then be printed atop the label 16 as required for each container shipment. The shipping laminate 14 is then suitably affixed to the container so that the container may then be shipped or sent to the first address 18 viewable atop the label 16.

The intended recipient may, for various reasons, desire to re-use the same container 10 for returning the same item 12 to the original sender, or a different item or article 24, as illustrated in FIG. 2, to the original sender or an alternate recipient. The container itself may be opened and reclosed in any suitable manner for removing the original article 12, and either repacking that article or the second article 24 in the same container for reshipment.

Once the container is repackaged, the recipient may simply remove the original label 16 from the liner 20 to expose the second address 22 hidden therebelow as illustrated in FIGS. 1 and 2. The second address 22 may be the original sender, and the container may then be re-sent to the second address for return to the sender. Since the liner 20 remains attached to the container 10 it supports the original label 16 during the original shipment to the recipient, and then upon removal of the original label 16, the liner 20 provides a preaddressed return label for reshipping the same container to the specified second address 22.

An additional advantage of using the pressure sensitive label 16 is that once the label 16 is removed from the container it may be reapplied to the same container at a different location away from the liner 14. As initially shown in FIG. 1, the container 10 typically also includes a return area or zone 26 at a suitable location spaced away from the shipping laminate 14 in which a return address 28 may be suitably printed.

In a preferred embodiment, the removed label 16 is reapplied atop the return zone 26 as shown in FIG. 2 to hide or cover the original return address 28, which is then supplanted by the first address 18 already printed on the label 16. That first address 18 identifies the original recipient from whom the container is being reshipped to the second address 22. The original shipping laminate 14 therefore provides two integrated address labels, including the top label 16 and the underlying liner 20 itself, for addressing the container to the original recipient, as well as addressing the container to the second address by simply removing the label 16 and reapplying it over the return zone 26 if desired.

Figure 3:
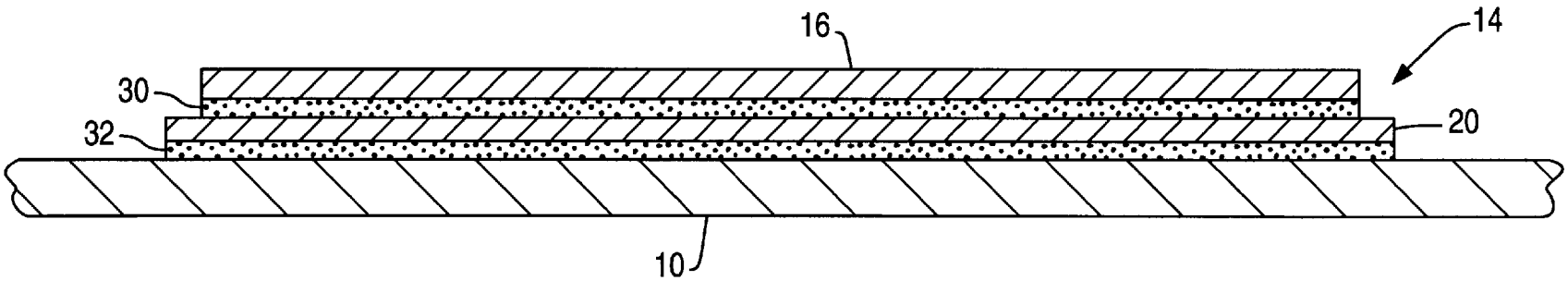
FIG. 3 is an elevational sectional view through the shipping label illustrated in FIG. 1 and taken along line 3—3.

A sectional view of the shipping laminate 14 affixed atop the container 10 is illustrated in more detail in FIG. 3. The label 16 and liner 20 are typically flat sheets having opposite sides or surfaces defining the fronts and backs thereof. The label 16 includes a first or label adhesive 30 disposed between the label back and the liner front. The adhesive is conventional and is permanently bonded to the label, but releasably bonded to the underlying liner.

The liner back includes a second or liner adhesive 32 which may have any suitable composition for bonding or affixing the liner 20 to the container 10. The liner adhesive 32 may be a gum adhesive initially permanently bonded to the liner back which may be suitably wetted for bonding the liner back to the container.

Figure 4:
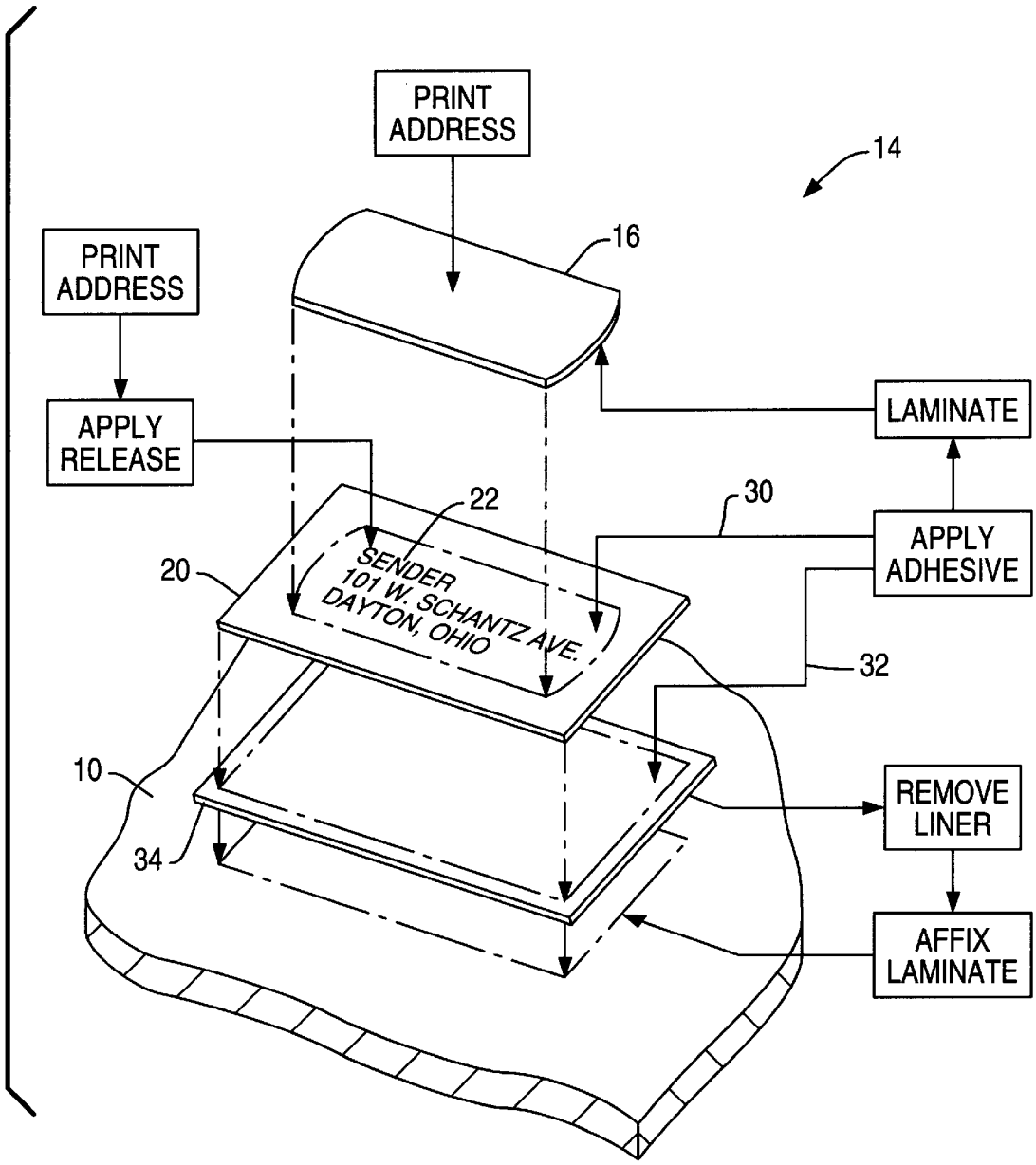
FIG. 4 is an exploded view of the shipping label illustrated in FIG. 1 and a corresponding flowchart for its manufacture and use in addressing the container.

In a preferred embodiment illustrated in FIG. 4, a second release liner 34 is disposed under the label liner 20, which defines a first liner. The back of the first liner 20 is releasably bonded to the front of the second liner 34 by the adhesive 32, with the first liner 20 itself being in the form of a typical pressure sensitive label. The front of the second liner 34 has a suitable release coating such as silicone for permitting the second liner 34 to be removed from the back of the first liner 20 so that the first liner 20 and attached label 16 may be bonded or affixed at any suitable location atop the container 10 illustrated in FIG. 1.

The individual shipping laminate 14 is an assembly of the label 16 atop the first liner 20, and optionally the second liner 34. The laminate may be manufactured in any conventional manner typically from a continuous roll of face stock which defines a series of the label 16 laminated with first and second liners 20,34 as desired, with the adhesives 30,32 being extruded therebetween during the laminating process.

In a preferred embodiment, the material forming the liner 20 is first preprinted with the desired second address 22 prior to application of the release agent such as a silicone liquid atop its front or face. In this way, the printed address is permanently formed on the first liner 20, with the release agent being applied thereover.

The individual shipping laminates 14, including the label 16 atop the preprinted first liner 20 atop the second liner 34, may be configured in groups on common sheets for use in a typical laser printer. The label sheet may include any suitable number of the individual shipping laminates 14 in one or more rows for providing multiple labels for corresponding shipping containers.

In use, the recipient first address 18 is printed atop the individual label 16, and the first and second liners 20,34 are separated for permitting the first liner 20 to be attached to the container, with the label 16 being integrated therewith. The container may then be shipped to the recipient, and the recipient may readily peel away the original label 16 to expose the recipient second address 22 for reshipping the same container thereto. The removed label 16 may be reapplied atop the return zone 26 as illustrated in FIG. 1 to cover the original return address with the original recipient address, which now identifies the new return address.

In a typical label sheet containing multiple shipping laminates of the type illustrated in FIG. 4, the second release liner 34 will preferably be continuous over the full extent of the sheet. The individual label 16 and integrated release liners 20 thereunder may have perimeters suitably die cut from their neighbors. In this way, each shipping label defined by the assembly of the address label 16 and supporting first release liner 20 may be peeled away collectively from the underlying second liner 34 and reapplied to a corresponding container using the same adhesive 32 found on the back of the liner. Similarly, when the label 16 is removed from the liner 20 by the recipient, the same adhesive 30 found on the back of the label 16 is used for reapplying the label at a different location atop the container.

The shipping label disclosed above improves the efficiency of reusing the same container 10 using the preaddressed label and underlying liner. The simple removal of the liner 16 from its liner atop the container and its reattachment over the original return address is easily and effectively accomplished. Both the original first liner 20 and the label 16 are thusly permanently bonded to the container for ensuring successful return of the container to the intended second recipient.

The shipping label disclosed above may be configured in the various configurations known for pressure sensitive labels by initially preprinting the face of the underlying liner with the intended recipient address. The shipping labels may be applied to boxes, tubes, envelopes, or any type of shipping or mailing container for enjoying return use thereof.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims.

What is claimed is:

1. A shipping laminate for addressing a shipping container comprising:

a label including a front face for printing a recipient first address, and a back having adhesive;

a release liner disposed under said label, and including a front having a release agent coated thereon with said label back being releasably bonded thereto by said adhesive; and said liner contains a recipient second address printed atop said liner front below said release agent and hidden behind said label, and viewable upon removal of said label.

2. A method of using said shipping laminate according to claim 1 comprising:

preprinting said second address atop said liner, and then applying said release agent thereover;

printing said first address atop said label;

affixing said laminate to said container;

sending said container to said first address;

removing said label from said liner to expose said second address; and resending said container to said second address.

3. A method according to claim 2 further comprising reapplying said removed label to said container away from said liner.

4. A method according to claim 3 wherein:

said container includes a return zone having a return address thereon; and said removed label is reapplied atop said return zone to cover said return address.

5. A laminate according to claim 1 wherein said liner further comprises a back opposite to said liner front and includes an adhesive for bonding said liner to said container.

6. A laminate according to claim 5 further comprising a second release liner disposed under said label liner which defines a first liner, with said first liner being releasably bonded to said second liner.

7. A method of using said shipping laminate according to claim 6 comprising:

printing said first address atop said label;

removing said second liner from said first liner;

affixing said first liner to said container;

sending said container to said first address;

removing said label from said first liner to expose said second address; and resending said container to said second address.

8. A method of using said shipping laminate according to claim 5 comprising:

printing said first address atop said label;

affixing said laminate to said container;

sending said container to said first address;

removing said label from said liner to expose said second address; and resending said container to said second address.

9. A method according to claim 8 further comprising reapplying said removed label to said container away from said liner.

10. A method according to claim 9 wherein:

said container includes a return zone having a return address thereon; and said removed label is reapplied atop said return zone to cover said return address.

11. A method according to claim 7 further comprising preprinting said second address atop said liner, and then applying a release agent thereover.

12. A laminate according to claim 5 wherein said label has a perimeter and is releasably bonded by said label adhesive to said liner atop said release agent within said label perimeter.

13. A method according to claim 8 further comprising preprinting said second address atop said liner, and then applying a release agent thereover.

* * * * *